United States Patent [19]

Harris

[11] 3,997,748

[45] Dec. 14, 1976

[54] VACUUM INTERRUPTER WITH PRIMARY ELECTRODE SURROUNDED BY HIGH DIELECTRIC STRENGTH SHIELD

[75] Inventor: Lawson P. Harris, Scotia, N.Y.

[73] Assignee: General Electric Company, Schenectady, N.Y.

[22] Filed: June 23, 1975

[21] Appl. No.: 589,516

[52] U.S. Cl. ..... 200/144 B

[51] Int. Cl.[2] ..... H01H 9/34

[58] Field of Search ..... 200/144 B, 144 R, 145

[56] References Cited

UNITED STATES PATENTS

| | | | |
|---|---|---|---|
| 3,786,214 | 1/1974 | Sofianek | 200/144 B |
| 3,914,568 | 10/1975 | Crouch | 200/144 B |

FOREIGN PATENTS OR APPLICATIONS

| | | | |
|---|---|---|---|
| 1,506,165 | 12/1967 | France | 200/144 B |
| 7,103,703 | 9/1971 | Netherlands | 200/144 B |
| 839,252 | 6/1960 | United Kingdom | 200/144 B |
| 1,163,272 | 9/1969 | United Kingdom | 200/144 B |

*Primary Examiner*—Gerald P. Tolin
*Attorney, Agent, or Firm*—Marvin Snyder; Joseph T. Cohen; Jerome C. Squillaro

[57] ABSTRACT

When the butt contacts of a vacuum arc discharge device are parted, at least one of the contacts is withdrawn into a high dielectric strength shield, giving the device high current interruption capability. The shield may be grounded to an endwall of the device or electrically isolated therefrom. Facing the stationary contact with a hardened steel enables it to withstand the dielectric stress extant at recovery. Facing the moving contact with a refractory material allows high current and voltage interruption capability without adversely affecting current chopping performance, while limiting contact erosion and weld forces.

10 Claims, 3 Drawing Figures

VACUUM INTERRUPTER WITH PRIMARY ELECTRODE SURROUNDED BY HIGH DIELECTRIC STRENGTH SHIELD

This invention relates to an improved high current, high voltage type electric circuit interrupter device, and more particularly to a vacuum interrupter wherein the primary arc electrodes exhibit improved wear qualities and are more effectively protected from high electric fields during the dielectric recovery period of the interruption cycle.

A continuing effort exists to develop vacuum interrupter devices capable of conducting large amplitude arcing currents during overload conditions at high voltages. The requirement for high voltage interruption capability, however, which necessarily requires wide spacing between opened electrodes to prevent undesired arcing therebetween, conflicts with the desired characteristic of small size. L. P. Harris U.S. Pat. No. 3,769,538, "Vacuum Arc Devices With Ferrous Electrodes", issued Oct. 30, 1973, and J. A. Rich U.S. Pat. No. 3,679,474, "Periodic Electrode Structure for Vacuum Gap Device", issued July 25, 1972, both assigned to the instant assignee, make possible improved vacuum discharge devices for carrying high currents at increased A. C. voltage levels through use of a periodic, ring-shaped structure of opposed and interleaved cylindrical rod-like electrode members surrounding a pair of primary arc electrodes which, upon parting, initiate an electric arc therebetween. When the primary arc electrode contacts become sufficiently separated, the arc transfers to the surrounding rod electrodes, jumping in electrically parallel paths across the gaps between adjacent rod electrodes. Until arcing current amplitude passes through zero, the plurality of high current arcs resulting from the overload current passing through the array of rod electrodes is sustained by a conductive plasma comprising metallic particles from the rod electrodes. When arcing current amplitude passes through zero, the specie of the plasma cool and condense upon the relatively cool surface of a sidewall member of the hermetically sealed evacuated envelope containing the primary arc elecrodes and array of rod electrodes. When the next cycle of alternating voltage is applied across the open primary arc electrode contacts, the high dielectric strength of the vacuum within the device prevents resumption of the current.

While the apparatus of the type described in the aforementioned Harris and Rich patents constitutes a substantial advance over the prior art, a further improvement in its capability is desirable. In particular, protection of the primary arc electrode contacts from high electric fields during the dielectric recovery period (i.e., after occurrence of current zero) is desirable in order to prevent reestablishment of an arc between the primary arc electrodes and thereby increase current interruption capability of the device. Additionally, though refractory metals have been used in electrode contacts of relatively low power vacuum interrupters, they have not been used in high power vacuum interrupters of the type concerned herein, primarily because they suffer from poor current chopping characteristics and low current interruption capability as noted in F. H. Horn U.S. Pat. No. 3,140,373. "Arc Ionizable Beryllium Electrodes for Vacuum Arc Devices", issued July 7, 1964, and T. H. Lee et at. U.S. Pat. No. 2,975,256, "Vacuum Type Circuit Interrupter", issued Mar. 14, 1961. However, refractory metals have desirable characteristics for high power vacuum interrupter operation including high mechanical strength, good electrical conductivity, low arc erosion, low welding tendency, high arcing voltage in vacuum, and relatively low cost.

One object of this invention is to provide a high current, high voltage, vacuum arc interrupter with primary arc eletrode contacts protected from high electric fields during dielectric recovery.

Another object is to provide a high power vacuum interrupter of configuration permitting advantageous use of refractory metal contacts without deleterious effect on current interruption capability.

Another object is to provide a vacuum interrupter device with a refractory metal contact which is retracted into a high dielectric strength shield when current is interrupted by the device.

Briefly, in accordance with a preferred embodiment of the invention, an improved vacuum arc device adapted to interrupt high currents at high voltages comprises an evacuated envelope having a pair of opposed, conductive endwalls and an insulating sidewall. A first plurality of spaced cylindrical rod electrodes extends inwardly from a first of the endwalls. A second plurality of spaced cylindrical rod electrodes extends inwardly from the second of the endwalls. The electrodes of the first and second pluralities are interdigitated to form a single, annular array of spaced rod electrodes, each having a smooth, cylindrical arcing surface. A high dielectric strength shield is situated between the annular array of rod electrodes and a central pair of primary arc electrodes that carry the normal load current. The contacts of the primary arc electrodes are separated upon occurrence of an overload condition requiring excessive load current, initiating an arc therebetween, contact separation being achieved by retracting at least one of the primary arc electrodes. The shield comprises a hollow cylindrical member surrounding the contact surface of a movable primary arc electrode in its separated or retracted position, protecting the moving contact from high arc currents and electric fields during dielectric recovery. Typically, the peak arcing current may exceed 100,000 amperes at a voltage of at least 38 kV. Application of the terminology "high dielectric strength" herein to any of the materials employed in the vacuum interrupter of the invention pertains, as is customary in the art, to the fact that a relatively high voltage is required to produce arcing in a vacuum between electrodes of such material.

BRIEF DESCRIPTION OF THE DRAWINGS

The features of the invention believed to be novel are set forth with particularity in the appended claims. The invention itself, however, both as to organization and method of operation, together with further objects and advantages thereof, may best be understood by reference to the following description taken in connection with the accompanying drawings in which:

DESCRIPTION OF TYPICAL EMBODIMENTS

Figure 1:
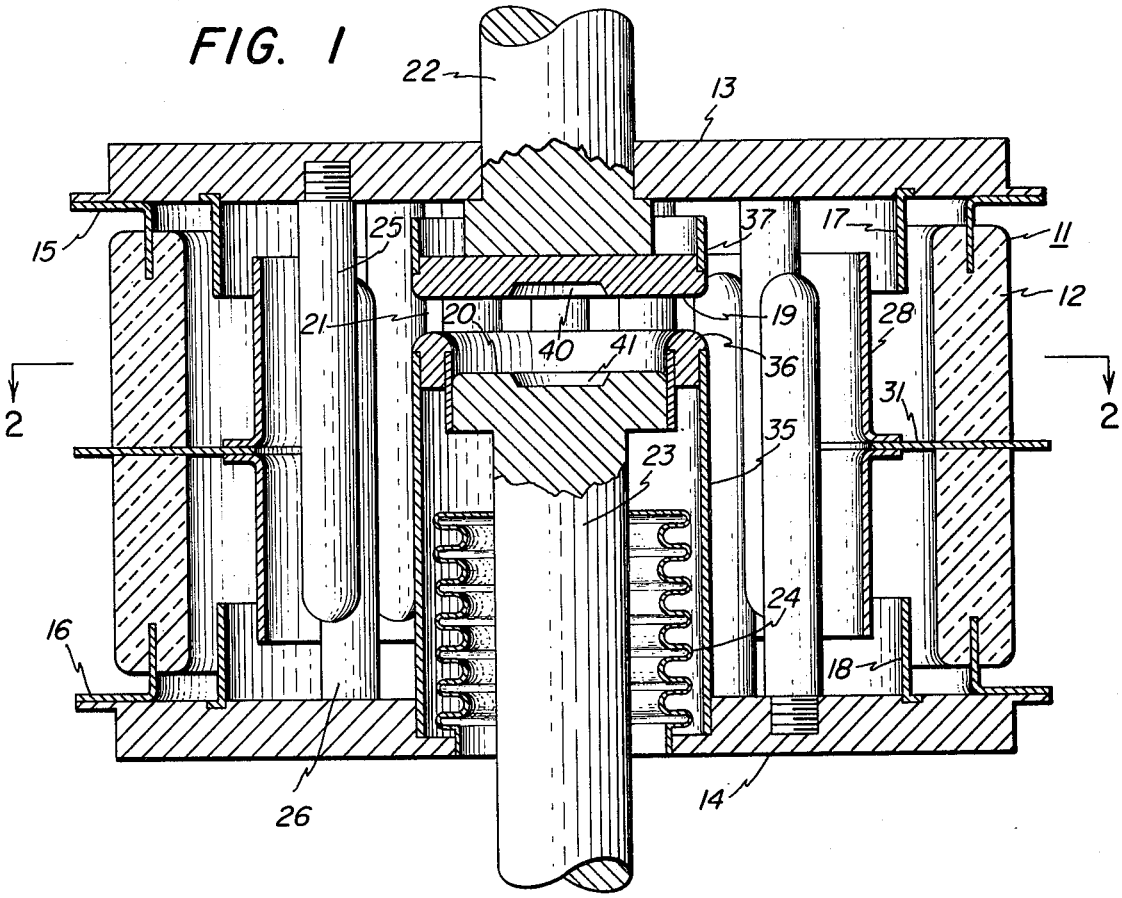
FIG. 1 is a vertical cross-sectional view, with parts broken away, of a vacuum interrupter device constructed in accordance with a first embodiment of the invention.

In FIG. 1, a vacuum switch or interrupter device constructed in accordance with the invention is shown comprising an evacuable envelope 11 including an electrically insulating cylindrical sidewall 12 hermetically sealed to opposed, conductive endwalls 13 and 14. Sidewall 12 may be typically fabricated of a glass such as General Electric "Rex", Corning "Pyroceram", or any of the many vacuum-tight glasses well known to the art, or of a higher density alumina. Endwalls 13 and 14 are disk-shaped, having aligned central holes therethrough, and may be typically fabricated of maraging steel such as Vascomax 300 CVM having a 30 Rockwell C hardness, available from VASCO, Latrobe, Pa. Sidewall 12 is sealed hermetically to endwalls 13 and 14 by any conventional glass-to-metal or ceramic-to-metal seal such as by use of flanges 15 and 16 which are imbedded in sidewall 12 and are joined by welding, brazing, etc., to the periphery of upper and lower endwalls 13 and 14, respectively. A vacuum on the order of $10^{-5}$ torr is typically maintained within envelope 11.

Sidewall 12 is protected from the deleterious effects of exposure to an electron-ion plasma created during intense arcing conditions within envelope 11 by providing concentric metallic endshields 17 and 18 connected at their far ends to endwalls 13 and 14, respectively, and a concentric, central, metallic cylindrical shield 28 of smaller diameter then endshields 17 and 18. Shields 17, 18 and 28 are typically fabricated of stainless steel. Shield 28, the ends of which are overlapped by shields 17 and 18, is supported by a flat, metallic ring 31 which is circumferentially sealed to sidewall 12 by a metal-to-glass or metal-to-ceramic bond within the central portion of insulating sidewall 12. By using shields 17, 18 and 28 to protect sidewall 12 from the aforementioned electron-ion plasma, the inner surface of sidewall 12 remains essentially nonconductive.

Located concentrically with the centers of endwalls 13 and 14 are a pair of aligned primary arc electrodes 19 and 20 comprising massive butt contacts which define an arcing gap 21 therebetween when the contacts are separated in open circuit position, as illustrated. Electrodes 19 and 20 are supported upon respective aligned cylindrical arc electrode support members 22 and 23 protruding through endwalls 13 and 14. Stationary electrode support member 22 is electrically and mechanically affixed to upper endwall 13. Electrode support member 23 is reciprocally movable through a central opening in lower endwall 14. A bellows assembly 24, hermetically sealed at one end to electrode support member 23 and at the other end to endplate 14, serves to maintain vacuum integrity within envelope 11 while permitting reciprocal movement of arc electrode support member 23.

During normal load current conditions, current is conducted through electrode support member 22, mated contacts 19 and 20, and electrode support member 23. The distal end of electrode support member 22 and baseplate 14 are respectively connected to terminal members (not shown) which incorporate the interrupter device in an A. C. circuit. Additionally, member 23 is connected externally to baseplate 14 through a flexible conductor (not shown). In a typical application, the interrupter is connected in series with an electrical load.

Figure 2:
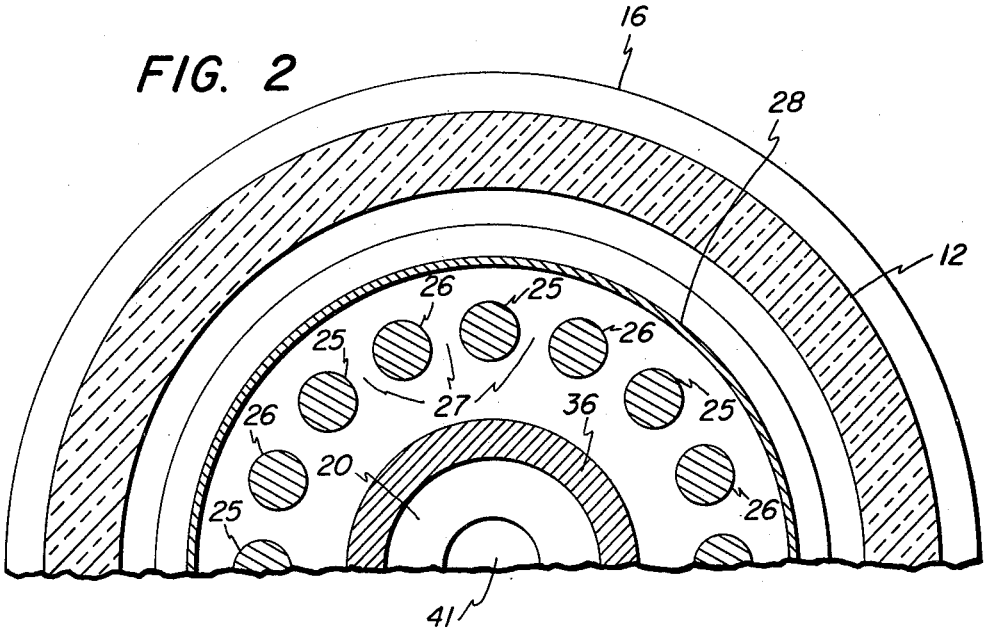
FIG. 2 is a horizontal sectional view taken along lines 2—2 in FIG. 1.

Surrounding contacts 19 and 20, and situated inwardly of shield 28, is a circular array of interdigitated, regularly-spaced electrode members including a plurality of downwardly-depending members 25 supported from upper endwall 13 in any convenient manner, such as by fastening into threaded sockets formed in endwall 13, and plurality of upwardly-depending members 26 supported from lower endwall 14 in similar fashion. Each of electrode members 25 and 26 is a smooth-surfaced, cylindrical rod, preferably of solid construction but hollow if desired, conveniently fabricated of copper, or of hardened ferrous material of the type described in L. P. Harris U.S. Pat. No. 3,769,538, or any other suitable material which provides a copious quantity of metallic particles during arcing to act as current carriers during an overload condition. The geometrical arrangement of rod electrodes 25 and 26 results in a plurality of equal length interelectrode gaps 27 between each adjacent pair of alternating rod electrodes 25 and 26, as illustrated in FIG. 2. The size of each interelectrode gap 27 is substantially smaller than the spacing between the ends of rod electrodes 25 and 26 and adjacent endwalls 13 and 14, respectively, in order to prevent arcing from the end of any rod electrode to the endwall separated therefrom.

An annular inner shield 35 about bellows 24 and electrode support member 23, comprised of high dielectric strength material such as steel, is situated to allow retraction of contact 20 into its interior when primary arc electrode contacts 19 and 20 are parted, contact 20 moving into a ferruled portion 36 of shield 35. Consequently, shield 35, which is mechanically and electrically connected to endwall 14, encircles the electric arc initiated between contacts 19 and 20 when parting during an overload current condition. An annular shield 37 surrounds all but the face of stationary primary arc electrode contact 19, and is electrically connected thereto. Shield 37, which is comprised of high dielectric strength material such as steel, prevents the electric arc initiated between contacts 19 and 20 when parting during an overload current condition, from running back on electrode support member 22 which is normally of a high conductivity material. Sufficient distance between shields 35 and 37 is necessary in order that the arc initially struck between contacts 19 and 20 may be transferred to rod electrodes 25 and 26 as described, infra.

Shield 35 may be fabricated of a single piece of steel or, alternatively, may be conveniently fabricated of an outer cylindrical element, a shorter inner cylindrical element, and an annular element joining one end of each of the two cylindrical elements, the elements being formed into an integral shield by any suitable means such as welding. The inner portion of shield 37 is supported from the side surface of contact 19. However, the inner portion of shield 35 is slightly spaced from the side surface of contact 20 to avoid sliding friction between these two elements. By surrounding bellows 24, shield 35 protects it from the arc drawn between parting contacts 19 and 20 and from the conductive plasma subsequently developed between cylindrical rod electrodes 25 and 26, as described, infra.

In operation under normal load current conditions, current is conducted centrally through the interrupter along a path defined by primary arc electrode support member 22, contacts 19 and 20 which are closed by being in abutting relationship, and primary arc electrode support member 23. When an overload current (i.e., a predetermined excessive load current of up to 10 to 20 times normal amplitude) is detected, contact 20 is retracted by outward movement of support member 23, and an arc is struck in gap 21 as contacts 19 and 20 are parted. When contacts 19 and 20 are separated, the arc is transferred from contacts 19 and 20 to the array of rod electrodes 25 and 26. This transfer is initiated by having shaped each of contacts 19 and 20 with a respective recess 40 and 41 therein to form a looping current path through the closed contacts that, upon parting of the contacts, results in electromagnetic impulsion of the arc radially outward. After transfer of the arc to the array of rod electrodes 25 and 26, the arc distributes itself over parallel paths 27, shown in FIG. 2, between oppositely-poled pairs of adjacent rod electrodes. Consequently, the arc between each pair of adjacent rod electrodes exhibits a lower voltage drop than the previously-existing arc across contacts 19 and 20.

The plurality of arcs across interelectrode gaps 27 resulting from the overload current passing through the array of rod electrodes 25 and 26 is sustained by a conductive plasma comprised of metallic particles released from electrodes 25 and 26 during arcing therebetween. This plasma permits maintenance of an arc across each of gaps 27, in parallel conductive paths, until the load current passes through zero amplitude and conduction ceases. This gives the specie of the plasma an opportunity to cool and condense upon the relatively cool surface of shield 28. When the next cycle of alternating voltage is applied across the open contact electrodes, the high dielectric strength of the vacuum within the interrupter prevents reestablishment of load current. The interrupter remains nonconductive until contacts 19 and 20 are again closed.

The asymmetry in location of contacts 19 and 20, while not necessary for proper operation of the interrupter, serves to make more effective cooling possible, to shorten the interrupter so as to increase its load current rating, and to situate the blast of contact vapor at opening near the tips of rod electrodes 26 where the electric fields are rod electrodes.

A major advantage in using shields 35 and 37 is that stationary contact 19 may be faced with, or constructed of, a high interruption capability, high dielectric strength material, such as a hardened steel, enabling it to withstand the required dielectric stress at recovery, while contact 20 may be fabricated of refractory materials such as molybdenum, niobium and tungsten, and such composite materials as tungsten-copper, tungsten-silver, nickel-copper, molybdenum-copper and molybdenum-silver. Tungsten carbide and titanium carbide are also useful as refractory materials from which contact 20 may be fabricated. The relatively slow dielectric recovery of many of these materials is not a drawback in the interrupter structure of FIG. 1, since shield 35 protects contact 20, together with bellows 24, from high arc currents late in the arcing period and from high electric fields during dielectric recovery. Moreover, the high ultimate strength and low contact erosion that can be obtained by using these materials are known to be advantageous. By facing stationary contact 19 with steel and facing movement contact 20 with molybdenum for example, high current and voltage capability with low contact erosion, low weld forces, and satisfactory current chopping performance (i.e., avoidance of forcing the load current to zero abruptly and prematurely before a natural current zero is reached) are achieved at low cost.

The apparatus illustrated in FIGS. 1 and 2 is satisfactory for interrupting large overload currents of up to approximately 30,000 amperes in 15 kilovolt circuits. For interrupting currents of substantially larger amplitudes, however, there exists a strong possibility that shield 35, being electrically connected to endwall 14, might draw arc current of sufficient amplitude to cause major mechanical damage. To overcome this problem, an isolated shield around the movable contact may be employed.

A major cause of failure of shields in large, high voltage, vacuum interrupters in puncture of the shield by arcs passing through the shield, areally, from either electrode to the opposite terminal of the interrupter. In general, therefore, a light shield can be employed in a rod electrode-type interrupter up to its current interruption limit as long as the shiled remains electrically isolated from the interrupter terminals. However, an isolated shield surrounding a contact in an interrupter does little to protect the contact from high electric fields and may even increase electric field intensity at the contact surface. Thus it is desirable for the protective shield to be electrically connected to the contact when high voltage appears across the interrupter. Since the arcing voltages of vacuum gaps are low, these apparently conflicting requirements can be met by isolating the contact protective shield from the contact and baseplate through a relatively weak dielectric gap. In this fashion, isolation of the shield and negligible shield currents are maintained while the interrupter carries high currents, and the shield is electrically connected to the contact to reduce electric field intensity at the contact surface when voltage between contact and shield exceeds a predetermined arcing amplitude.

Figure 3:
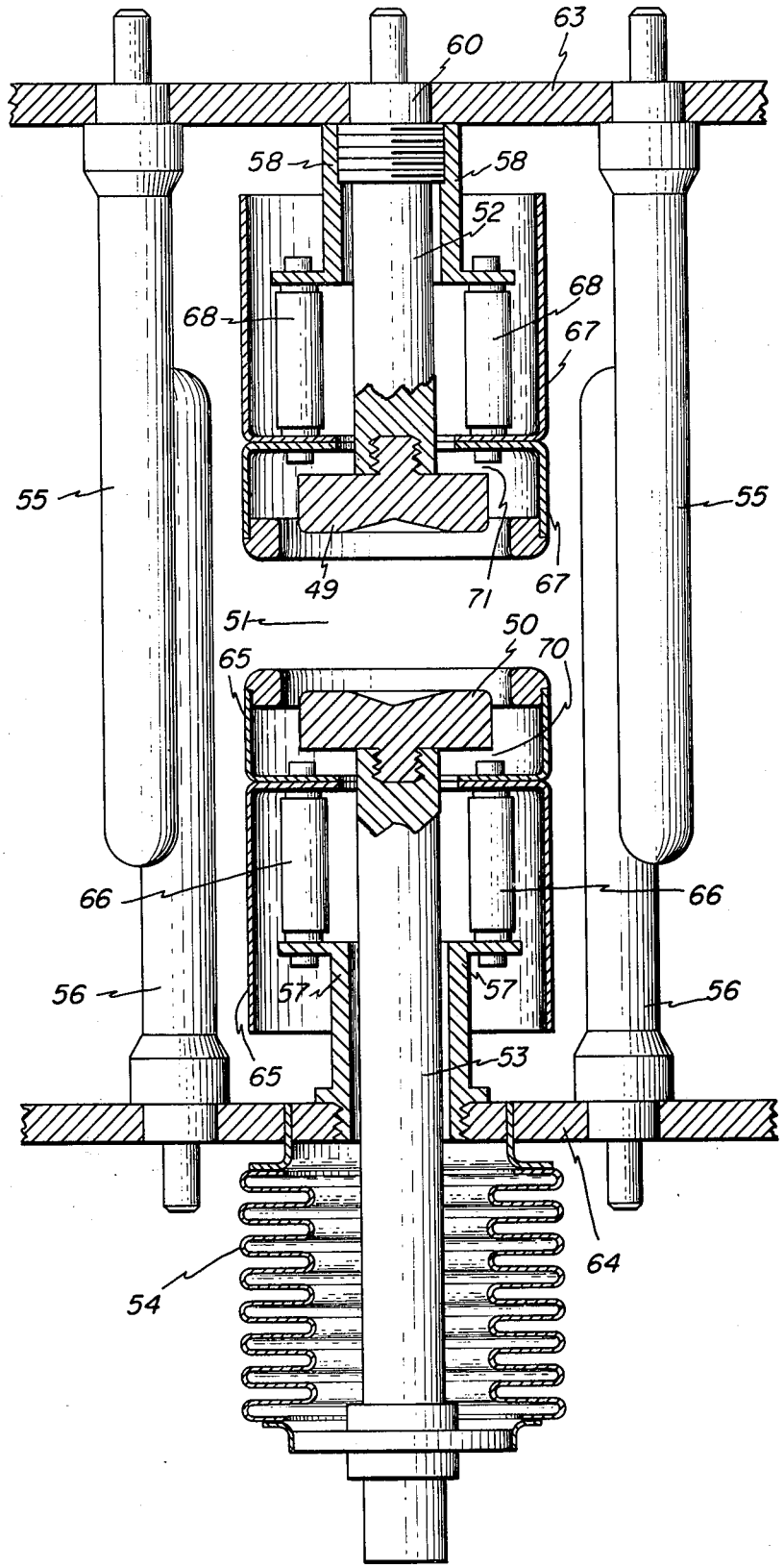
FIG. 3 is a vertical cross-sectional view, with parts broken away, of a portion of a vacuum interrupter device constructed in accordance with a second embodiment of the invention.

FIG. 3 illustrates a portion of a vacuum interrupter in which the fixed primary arc electrode contact 49 is surrounded by a high dielectric strength shield 67 which extends around a major portion of arc electrode support member 52 in the interrupter. Movable primary arc electrode contact 50, shown in its retracted position, in surrounded by a high dielectric strength shield 65 which extends around a major portion of arc electrode support member 53 in the interrupter. Shields 65 and 67 are supported by insulators 66 and 68, respectively, which, in turn, are supported on flanged cylinders 57 and 58, respectively. Cylinder 57 is screwed into lower baseplate 64 while cylinder 58 is screwed onto a support member 60 which is joined, as by welding, to arc electrode support member 52 and to upper baseplate 63. Support member 60 and lower baseplate 64 are electrically connected in an A.C. circuit protected by the interrupter, with arc electrode support member 53 being connected externally to baseplate 64 through a flexible conductor (not shown).

A plurality of downwardly-depending rod electrodes 55 are joined to baseplate 63 as by welding, while a plurality of upwardly-depending rod electrodes 56 are joined to baseplate 64 as by welding. Electrodes 55 and 56 are interdigitated in alternating fashion and regularly-spaced in a circular array. Bellows 54, being situated outside baseplate 64, is protected from arc damage thereby. Baseplates 63 and 64 form the endwalls of an evacuated envelope, the insulating sidewall of which (not shown) is sealed thereto in a manner similar to that illustrated for the apparatus shown in FIG. 1, surrounds the array of rod electrodes 65 and 66, and is protected by shields (not shown) in a manner essentially similar to the protection afforded sidewall 12 by shields 17, 18 and 28 in FIG. 1.

Shields 65 and 67 are isolated from contacts 50 and 49, respectively, by relatively weak dielectric gaps, but each shield is electrically connected to its respective contact to reduce the electric field at the contact surface when voltage between the contact and its respective shield exceeds a predetermined value. Breakdown voltage of the weak dielectric gap extant between either one of contacts 49 and 50 and its associated shield 67 and 65, respectively, is preferably between approximately 10 kilovolts and about two-thirds the peak value of the nominal interrupter service voltage.

Although ideally a lead could be attached to each of isolated protective shields 65 and 67 and brought through the interrupter envelope by an insulating feedthrough to an external voltage limiting device, it is more practical to mount protective shields 65 and 67 on insulating posts 66 and 68, respectively. The movable contact voltage-limiting gap 70 and fixed contact voltage limiting gap 71 are thus built in the structure away from the main blast of vapor from the arc, and sparkover of either voltage limiting gap does not trigger vacuum interrupter conduction or cause metal deposition on insulators 66 and 68.

Movable contact 50 is retracted into shield structure 65 when the interrupter is actuated by an overload current. As contacts 50 and 49 thus become parted, an arc is struck in gap 51 between contacts 50 and 49 and, when the contacts are separated, the arc is transferred from contacts 50 and 49 to the array of rod electrodes 55 and 56, the transfer being initiated by suitably shaping contacts 50 and 49 to electromagnetically impel the arc radially outward. After transfer of the arc to the array of rod electrodes 55 and 56, the arc distributes itself over parallel paths between oppositely-poled pairs of adjacent rod electrodes. Consequently, the arc between each pair of adjacent rod electrodes exhibits a lower voltage drop than the previously-existing arc across contacts 50 and 49.

The plurality of arcs between adjacent rod electrodes 55 and 56 are sustained by a conductive plasma comprised of metallic particles released from rod electrodes 55 and 56 during arcing therebetween. When load current passes through zero amplitude, conduction ceases, giving the specie of the plasma an opportunity to cool and condense upon the relatively cool surface of a shield (not shown) around the array of rod electrodes. When the next cycle of alternating voltage is applied across contacts 50 and 49, the high dielectric strength of the vacuum within the inerrupter prevents reestablishment of load current.

Much of the success achieved with the device shown in FIG. 3 must be attributed to presence of the rod electrode array arcing structure, which tends to arc at lower voltages than the refractory contacts and to take over most of the arc current within a few milliseconds after parting of the contacts. However, the contact shields are also important in that the device will fial to interrupt at currents much below its maximum capability if the current zero and recovery voltage should occur before the moving contact is withdrawn into its shield. Again, use of shielded contacts in the apparatus of FIG. 3 makes possible use of contacts fabricated of refractory materials of the type mentioned in conjunction with contact 20 in the apparatus of FIG. 1 without the heretofore attendant disadvantages of low current interruption capability and high chopping currents.

The foregoing describes a high current, high voltage, vacuum arc interrupter with primary arc electrode contacts protected from high electric fields during dielectric recovery. The interrupter configuration permits advantageous use of refractory metal contacts without deleterious effect on current interruption capability, one of which contacts is retracted into a high dielectric strength shield when current is interrupted by the device.

While only certain preferred features of the invention have been shown by way of illustration, many modifications and changes will occur to those skilled in the art. It is, therefore, to be understood that the appended claims are intended to cover all such modifications and changes as fall within the true spirit of the invention.

I claim:

1. A vacuum arc device adapted to interrupt high currents at high voltages comprising:

an evacuated envelope having a pair of opposed, conductive endwalls and an insulating sidewall;

a first plurality of spaced cylindrical rod electrodes extending inwardly from a first of said endwalls;

a secondary plurality of spaced cylindrical rod electrodes extending inwardly from the second of said endwalls and eing interdigitated with said first plurality to form a single, annular array of spaced rod electrodes;

a central pair of primary arc electrodes, each of said primary arc electrodes having a contact abutting the other contact when carrying normal load current, one of said primary arc electrodes being electrically connected to the first of said endwalls and the other of said primary arc electrodes being electrically connected to the second of said endwalls; and a high dielectric strength shield situated between the annular array of rod electrodes and said one of said primary arc electrodes, said shield being electrically isolated from both of said endwalls;

said one of said primary arc electrodes being retractable into said shield so as to separate its contact from the contact of the other of said primary arc electrodes upon occurrence of an overload condition requiring excessive load current.

2. The apparatus of claim 1 including a second high dielectric strength shield situated between the annular array of rod electrodes and the other of said primary arc electrodes, said second shield encircling the contact on the other of said primary arc electrodes and being electrically isolated from both of said endwalls.

3. The apparatus of claim 1 including a bellows hermetically sealing the first of said endwalls to the retractable primary arc electrode.

4. The apparatus of claim 3 including a second high dielectric strength shield situated between the annular array of rod electrodes and the other of said primary arc electrodes, said second shield encircling the contact of the other of said primary arc electrodes and being electrically isolated from both of said endwalls.

5. The apparatus of claim 1 wherein the contact on the other of said primary arc electrodes comprises a high dielectric strength material.

6. The apparatus of claim 5 wherein the contact on the retractable primary arc electrode comprises a refractory metal.

7. The apparatus of claim 5 wherein the contact on the retractable primary arc electrode comprises molybdenum and the contact on the other of said primary arc electrodes comprises steel.

8. The apparatus of claim 5 wherein the contact on the retractable primary arc electrode comprises a metal of the group consisting of tungsten-copper, tungsten-silver, nickel-copper, molybdenum-copper and molybdenum-silver.

9. The apparatus of claim 5 wherein the contact on the retractable primary arc electrode comprises a metal of the group consisting of tungsten carbide and titanium carbide.

10. The apparatus of claim 5 wherein the contact on the retractable primary arc electrode comprises a metal of the group consisting of molybdenum, niobium and tungsten.

* * * * *